US005365617A

United States Patent [19]

Tarr

[11] Patent Number: 5,365,617

[45] Date of Patent: Nov. 22, 1994

[54] RETROFIT SWIMMING POOL WATER LEVELER AND METHOD

[75] Inventor: William C. Tarr, Glendale, Ariz.

[73] Assignee: Shasta Industries, Inc., Phoenix, Ariz.

[21] Appl. No.: 34,735

[22] Filed: Mar. 19, 1993

[51] Int. Cl.[5] ..... E04H 4/12

[52] U.S. Cl. ..... 4/508; 4/507; 137/428; 137/392

[58] Field of Search ..... 4/507, 508, 509, 541.2; 137/428, 392

[56] References Cited

U.S. PATENT DOCUMENTS

| | | | |
|---|---|---|---|
| 2,448,251 | 8/1948 | Campbell | 137/428 |
| 3,739,405 | 6/1973 | Schmidt | 137/428 |
| 3,848,616 | 11/1974 | Sanner | 137/392 |
| 3,848,627 | 11/1974 | Page | 137/392 |
| 3,895,402 | 7/1975 | Page | 4/172.17 |
| 4,373,220 | 2/1983 | Selsted | 4/508 |
| 4,380,091 | 4/1983 | Lively | 4/508 |
| 4,445,238 | 5/1984 | Maxhimer | 4/508 |
| 4,607,399 | 8/1986 | Yovanofski | 4/508 |
| 4,612,949 | 9/1986 | Henson | 137/2 |
| 4,686,718 | 8/1987 | Kinkead et al. | 4/508 |
| 4,724,552 | 2/1988 | Kinkead et al. | 4/508 |
| 4,817,217 | 4/1989 | Lively | 4/508 |
| 4,853,984 | 8/1989 | Celiano | 4/508 |
| 5,167,041 | 12/1992 | Burkitt, III | 4/509 |

*Primary Examiner*—Henry J. Recla
*Assistant Examiner*—Charles R. Eloshway
*Attorney, Agent, or Firm*—Cahill, Sutton & Thomas

[57] ABSTRACT

A system for automatically maintaining a desired water level in a swimming pool, includes a float chamber coupled in fluid communication with a suction tube that is coupled between the pool and a pool filter pump. A float carrying a magnetic element is disposed in the float chamber. A magnetic switch is located in a fixed position outside of the float chamber at a level corresponding to the desired water level. The magnetic switch assumes a first state if the pool water level is equal to or higher than the desired water level and assumes a second state if the pool water level is lower than the desired water level. A solenoid valve is connected between a pressurized water source and an intermediate portion of a return tube returning pumped water to the pool. A circuit is coupled to the valve and the magnetic switch to close the valve when the pump is operating, and open the valve when the pump is not running and the magnetic switch is in the second state.

18 Claims, 2 Drawing Sheets

RETROFIT SWIMMING POOL WATER LEVELER AND METHOD

BACKGROUND OF THE INVENTION

There are a number of prior devices for automatically maintaining water in a swimming pool at a desired level. Most of the prior devices include a float valve located in a water chamber adjacent to the pool. The interior of the chamber is in open fluid communication with the pool, so that the surface of water in the chamber is at the same level as the water surface of the pool. A mechanical, magnetic, or electronic sensor adjacent to the pool detects the level of a float and in response thereto water from a water supply line is metered into the pool until the desired water level has been reached.

There are several major problems with the prior devices. The most difficult problem is that none of the prior devices can be easily retrofit to a pre-existing swimming pool, because the prior devices generally require cutting suitable holes in the pre-existing pool deck and/or pool walls and providing the plumbing necessary to provide free fluid flow between the water level sensors of the prior devices and the swimming pool water.

There is an unmet need for an inexpensive, reliable device for maintaining the level of water in a swimming pool. It would be desirable for such a device to be easily retrofit to existing swimming pools without the need to cut holes in pre-existing pool deck and/or pool wall material.

SUMMARY OF THE INVENTION

It is an object of the present invention to provide an inexpensive, reliable water level maintaining device that is easily installed in an swimming pool water filtration system.

Briefly described, and in accordance with one embodiment thereof, the invention provides a system for automatically maintaining a desired water level in a swimming pool, including a float chamber coupled in fluid communication with a suction tube that is coupled between the pool and a pool filter pump and a float disposed in the float chamber and carrying a magnetic element. A magnetic switch is located in fixed position outside of the float chamber at a level corresponding to the desired water level. The magnetic switch assumes a first state if the pool water level is higher than the desired water level and assumes a second state if the pool water level is lower than the desired water level. A valve is connected between a pressurized water source and an intermediate portion of a return tube that returns pumped water to the pool. A control circuit is coupled to the valve and the magnetic switch to (1) close the valve when the pump is operating, and (2) open the valve when the pump is not running and the magnetic switch is in the second state. The system can be easily retrofit to a conventional swimming pool filtering system.

DETAILED DESCRIPTION OF THE PREFERRED EMBODIMENTS

Figures 1, 4:
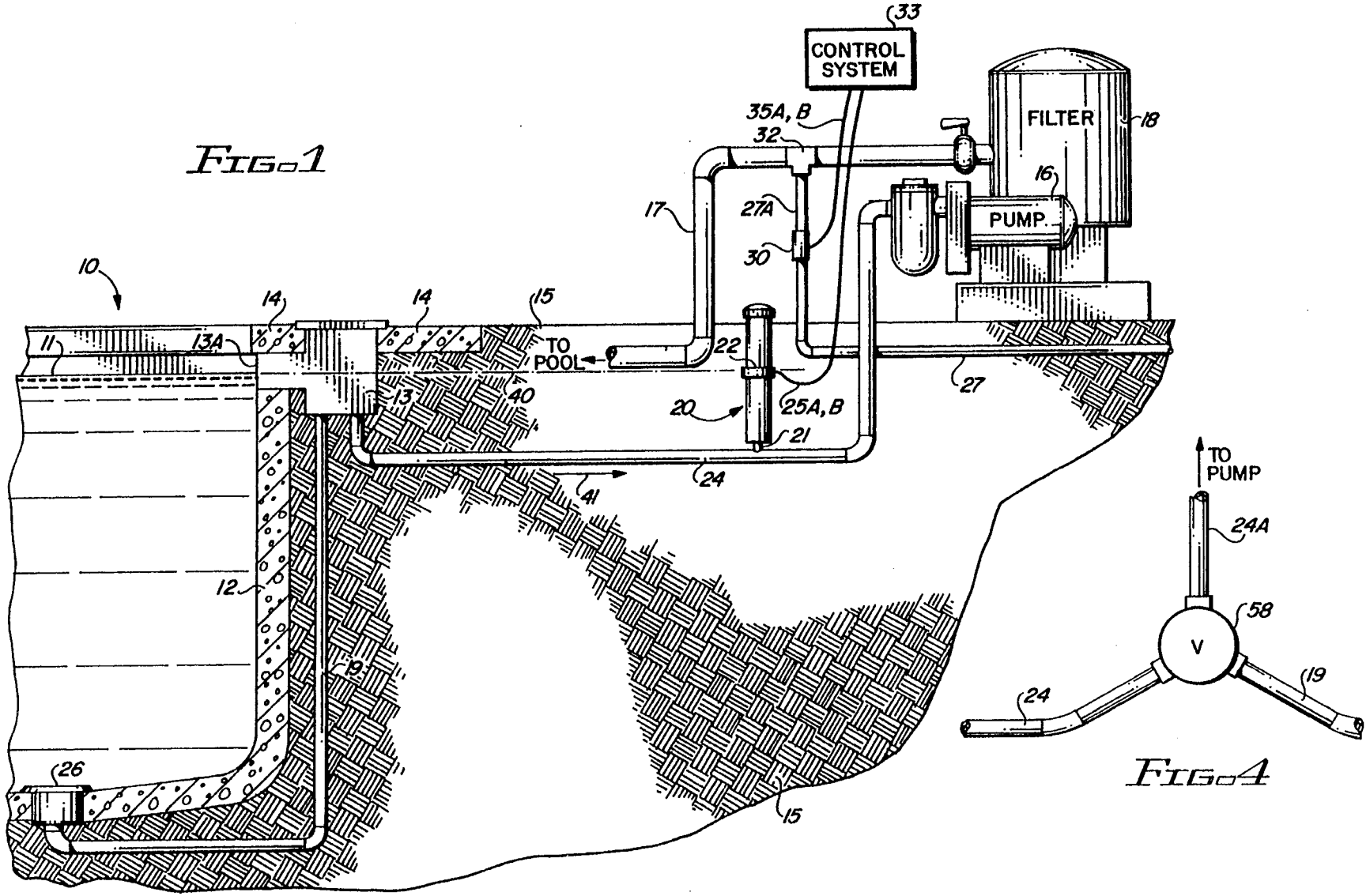
FIG. 1 is a partial section view diagram illustrating the swimming pool water level maintaining system of the present invention.
FIG. 4 is a diagram useful in describing an alternative embodiment of the system shown in FIG. 1.
Figure 2:
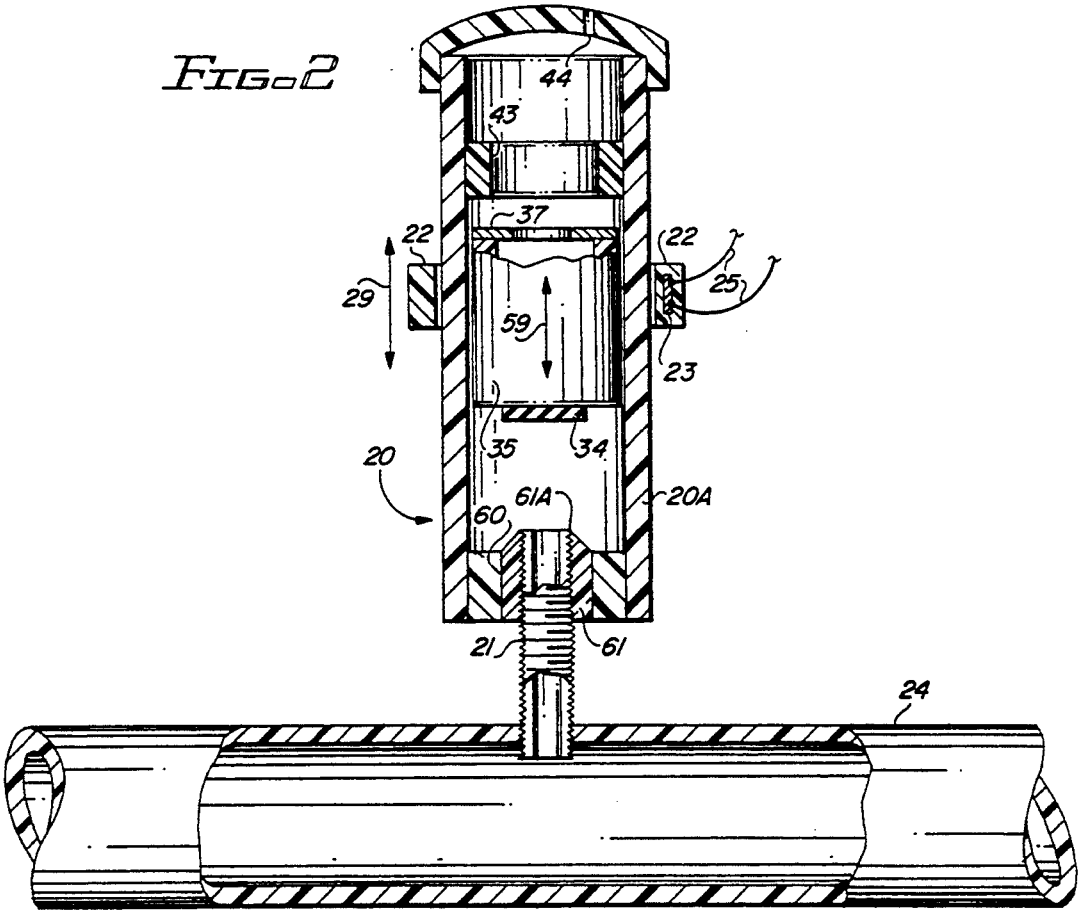
FIG. 2 is a section view illustrating the water leveling device included in the system of FIG. 1.

Referring to FIGS. 1 and 2, swimming pool 10 contains water 11, the surface of which must be maintained above the level of the inlet 13A of a conventional skimmer assembly 13. Numeral 14 designates a hard aggregate surface layer referred to as "pool decking". Numeral 15 designates the earth in which the pool is formed. A suction tube 24 extends from skimmer 13 to the of pool pump 16. Another tube 19 extends from the bottom of skimmer 13 to drain 26 at the bottom of swimming pool 10.

When pump 16 operates, water is drawn in the direction of arrow 41 from the surface of pool 10 through the inlet of skimmer 13 and through drain 26, through pipe 24 and into pump 16, is forced through filter 18, and then is returned through pool return pipe 17 back into pool 10 through a return opening or through multiple cleaning heads (not shown) located in the wall 12 of pool 10. (Alternatively, pipe 24 can be connected to an inlet of a valve 58, as shown in FIG. 4, and pipe 19 can be connected to another inlet of valve 58, instead of to skimmer 13. The outlet of valve 58 is connected to pump 16, so the full suction of pump 16 can be applied selectively to either skimmer 13 or drain 26. This same function alternatively could accomplished by means of two gate valves.)

The retrofit water level maintaining device of the present invention includes an assembly 20, shown in FIG. 1 and also shown in more detail in the section view of FIG. 2. Assembly 20 contains an internal float 35 that floats in float chamber 20A, which can be composed of a section of cylindrical PVC tube having an inside diameter of 1.5 inches. Float 35 has a magnetic element 37 attached thereto. A rubber disk 34 is attached to the bottom of float 35. Float chamber 20A and float 35 can be constructed of sections of suitable PVC pipe. The cap of float chamber 20A can be a PVC end cap, with an air vent hole 44 therein. Float 35 can be constructed of a section of PVC pipe with PVC end caps attached thereto. Magnetic element 37 can be a magnetic washer or the like that is captured between a PVC cap and section of PVC pipe of which float 20 is constructed.

A short tube 21 connected to the bottom of float chamber 20A fluid couples the interior of float chamber 20A to the interior of pipe 24. (If the embodiment of FIG. 4 is used, float chamber 20A is connected by tube 21 to pipe 24A between valve 58 and pump 16.) Tube 21 is threaded into a sleeve 61 in the bottom 60 of float chamber 20A. The upper edge of sleeve 61 is beveled as shown, providing a sharp circular edge 61A that can form a watertight seal with rubber disk 34 on the bottom of float 35. Consequently, when pump 16 is operating, suction produced in tube 24 pulls float 35 downward, so that disk 34 seals the top edge 61A of sleeve 61, preventing air in float chamber 20A from belong sucked into pipe 24 by pump 16. Under these conditions magnet 37 is below the desired water line and valve 30 is off, so no water from supply pipe 27 flows into the pool.

A float limit stop 43 establishes an upper limit to the position of float 35 in the float chamber, so that if pool 10 is overfilled (for example due to rain), magnet 37 can not rise far enough relative to magnetic 9 switch 23 in a sleeve 22 to allow magnetic switch 23 to open and thereby indicate the pool is underfilled when it actually is overfilled.

Figure 3:
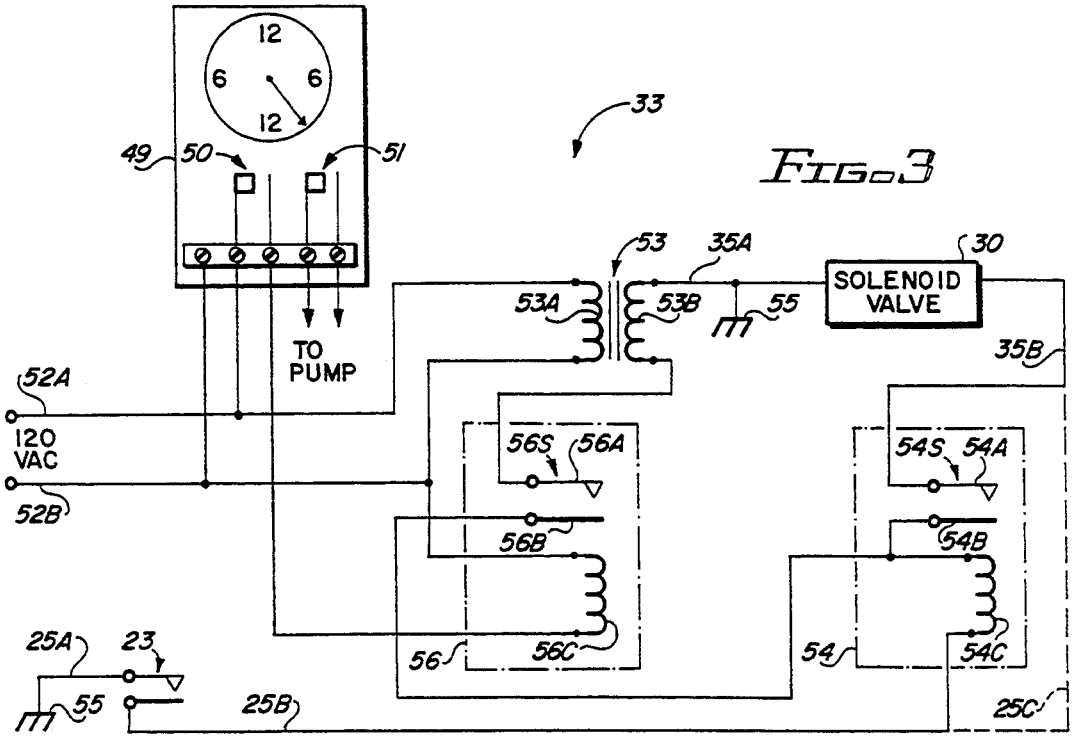
FIG. 3 is a diagram of a circuit that controls operation of the water leveling device shown in FIG. 2.

The sleeve 22 on the outer surface of float chamber 20A is adjustable in the directions of arrow 29 and carries magnetic reed switch 23 (FIG. 2) connected between a pair of conductors 25A, B that lead to a control system 33, which is shown in FIG. 3. Typically, control system 33 includes a timer that periodically turns on pump 16 to filter the water in swimming pool 10.

A pair of conductors 35A,B extend from control system 33 to a solenoid valve 30, the fluid inlet of which is connected to a pressurized water supply pipe 27 from, for example, a municipal water supply system. The fluid outlet of solenoid valve 30 is connected by a pipe section 27A into the pool return line 17 be means of a T-connector 32. Thus, when solenoid valve 30 is open, water from pipe 27 is added to swimming pool 10 through pool return pipe 17.

In accordance with the present invention, a signal on the control conductors 35A,B turn solenoid valve 30 on only when pool pump 16 is off. Consequently, there is no pressure in pipe 24 (due to operation of pump 16) when the water level maintaining device 20 is operating, so the water level float chamber 20A is the same as the level of surface 11 of pool 10. Then, if magnet 37 on float 20 is below the level corresponding to the pool water surface level 40, the magnetic switch 23A sends a signal via conductors 25A,B to control system 33, opening valve 30, causing pool 10 to be refilled.

FIG. 3 shows the details of control circuit 33. A conventional timer 49 includes a switch 50, one terminal of which is connected to a first terminal of primary winding 53A of transformer 53 and to one conductor 52A of a 120 volt AC power line. The other terminal of switch 50 is connected to one terminal of a coil 56C of a pump status relay 56. The other terminal of primary winding 53A is connected to conductor 52B of the AC power line, so primary winding 53A is continually energized by the AC power line 52A,B.

The secondary winding 53B of transformer 53 has one terminal connected by conductor 35A to ground 55 and to one terminal of solenoid valve 30. The other terminal of secondary winding 53B is connected to a terminal 56A of magnetic switch 56S of pump status relay 56. The other terminal 56B of magnetic switch 56S is connected to one terminal of coil 54C of valve control relay 54, and to terminal 54B of magnetic switch 54S of relay 54. Terminal 54A of switch 54S is connected by conductor 35B to the remaining terminal of solenoid valve 30. The second terminal of coil 54C of relay 54 is connected by conductor 25B to one terminal of magnetic switch 23A in sleeve 23. The other terminal of magnetic switch 23 is connected by conductor 25A to ground 55.

Switch 50 of time clock 49 is closed and switch 51 is open if pool pump 16 is off. Under these conditions, coil 56C of pump status relay 56 is energized, closing switch 56S so that its terminals 56A,B make electrical contact, causing secondary winding 53B to be energized if pool pump 16 is off and magnetic switch 54S also is closed.

If pool 10 is full, magnetic element 37 is positioned close enough to magnetic switch 23 to open it. Coil 54C is not energized, so magnetic switch 54S is open, and solenoid valve 30, (which is closed when not actuated) is maintained closed.

However, if the water level of pool 10 is low, magnetic switch 23 is beyond the influence of magnet 37 because float 35 has lowered, so magnetic switch 23 is closed, causing coil 54C to be energized. This closes switch 54S, causing 24 volt AC power from secondary winding 53B to be applied across the terminals of solenoid valve 30 through switches 54S and 56S, thereby opening solenoid valve 30 and allowing water from pressurized water supply line 27 to flow through solenoid valve 30 and return tube 17 into the swimming pool 10.

The assembly 20 is easily installed by digging or drilling a hole in the earth 15 above pipe 24, drilling a small hole in pipe 24 or 19, and threading or gluing a tube section 21 extending through the bottom of assembly 20 into that hole. The control system 33 is easily connected to have the configuration in FIG. 3. The water level sensing element, magnetic relay 23, does not come in contact with pool water and therefore avoids corrosion that reduces the reliability of prior devices.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention. For example, if magnetic switch 23 is of the type that is closed, rather than opened, by the close proximity of magnetic element 37, then magnetic relay 54 can be omitted (as its only function is to "invert" the information or signal on conductor 25B), the lower terminal of secondary winding 53B can be connected to ground, and conductor 25B can be connected directly to conductor 35B, as indicated by dotted line 25C. The magnetic element could be supported on and above the float, and the sensor could be supported adjacent to the magnetic element inside (or even outside) of the float chamber so as to accomplish the described operation.

What is claimed is:

1. A system for automatically maintaining a desired water level in a body of water in which the water is recirculated by a pump through a first tube coupled in fluid communication with the body of water and the pump and a second tube coupled in fluid communication with the pump and the body of water, the system comprising in combination:

(a) a float chamber located outside of the body of water and having an interior adapted to be coupled in fluid communication with the first tube;

(b) a float disposed in the float chamber;

(c) a sensor responsive to the level of the float located in fixed position relative to the float chamber at a level corresponding to the desired water level, the sensor assuming a first state if the water level of the body of water is at least equal to the desired water level and assuming a second state if the water level of the body of water is lower than the desired water level;

(d) a valve adapted to be connected between a pressurized water source and the second tube; and (e) a circuit coupled to the valve and the sensor to (1) close the valve when the pump is operating to prevent pressure of water being pumped through the first tube from influencing the level at which water is maintained, and (2) open the valve only when the pump is not running and the sensor is in the second state.

2. The system of claim 1 wherein the float chamber is composed of plastic.

3. A system for automatically maintaining a desired water level in a swimming pool in which the water is recirculated by means of a pump through a first tube coupled in fluid communication with the pool and the pump, the system comprising in combination:

(a) a float chamber located outside of the pool having an interior adapted to be coupled in fluid communication with the first tube;

(b) a float disposed in the float chamber, carrying a magnetic element;

(c) a magnetic switch responsive to the level of the magnetic element located in fixed position outside of the float chamber at a level corresponding to the desired water level, the magnetic switch assuming a first state if the pool water level is at least equal to the desired water level and assuming a second state if the pool water level is lower than the desired water level;

(d) a valve adapted to be connected between a pressurized water source and a pre-existing tube coupled in fluid communication with the pool; and (e) a circuit coupled to the valve and the magnetic switch so as to (1) close the valve when the pump is operating to prevent pressure of water being pumped through the first tube from influencing the level at which water is maintained in the pool, and (2) open the valve only when the pump is not running and the magnetic switch is in the second state.

4. The system of claim 3 wherein the float chamber has an air vent in an upper portion thereof.

5. The system of claim 3 including a seal element associated with the float for preventing the fluid communication between the interior of float chamber and the suction tube when the pump is operating.

6. The system of claim 5 wherein the seal element includes a seal pad connected to a bottom of the float and a matching edge surface of a conduit fluid coupling the interior of the float chamber to the suction tube, suction produced in the suction tube by operation of the pump drawing water out of the float chamber and lowering the float, causing the seal pad to form a seal with the matching edge.

7. The system of claim 3 wherein the first tube is adapted to be connected to a skimmer connected in fluid communication with the pool.

8. A system for automatically maintaining a desired water level in swimming pool in which the water is recirculated by means of a pump through a first tube coupled in fluid communication with the pool and the pump, the system comprising in combination:

(a) a float chamber having an interior adapted to be coupled in fluid communication with the first tube;

(b) a float disposed in the float chamber, carrying a magnetic element;

(c) a magnetic switch responsive to the level of the magnetic element located in fixed position outside of the float chamber at a level corresponding to the desired water level, the magnetic switch assuming a first state if the pool water level is at least equal to the desired water level and assuming a second state if the pool water level is lower than the desired water level wherein the magnetic switch is a magnetic relay actuated by close proximity of the magnetic element;

(d) a valve adapted to be connected between a pressurized water source and a pre-existing tube coupled in fluid communication with the pool; and (e) a circuit coupled to the valve and the magnetic switch so as to (1) close the valve when the pump is operating to prevent pressure of water being pumped through the first tube from influencing the level at which water is maintained in the pool, and (2) open the valve only when the pump is not running and the magnetic switch is in the second state; and (f) a stop disposed in the chamber to limit upward movement of the float, to thereby prevent the magnetic switch from assuming the second state if the pool is substantially overfilled.

9. The system of claim 8 wherein a portion of the stop is adjustable relative to the float chamber.

10. The system of claim 8 including a slidable sleeve carrying the magnetic switch and disposed about the float chamber to allow adjusting of the desired pool water level.

11. A system for automatically maintaining a desired water level in a swimming pool in which the water is recirculated by means of a pump through a first tube coupled in fluid communication with the pool and the pump, the system comprising in combination:

(a) a float chamber having an interior adapted to be coupled in fluid communication with the first tube;

(b) a float disposed in the float chamber, carrying a magnetic element;

(c) a magnetic switch responsive to the level of the magnetic element located in fixed position outside of the float chamber at a level corresponding to the desired water level, the magnetic switch assuming a first state if the pool water level is at least equal to the desired water level and assuming a second state if the pool water level is lower than the desired water level;

(d) a valve adapted to be connected between a pressurized water source and a pre-existing tube coupled in fluid communication with the pool; and (e) a circuit coupled to the valve and the magnetic switch so as to (1) close the valve when the pump is operating to prevent pressure of water being pumped through the first tube from influencing the level at which water is maintained in the pool, and (2) open the valve when the pump is not running and the magnetic switch is in the second state, wherein the valve is a solenoid valve that is closed when not actuated, the circuit including a transformer having a primary winding energized by AC line current when the pump is not operating and a secondary winding connected to actuate the solenoid valve in response to the magnetic switch when it is in the first state.

12. A system for automatically maintaining a desired water level in a swimming pool in which the water is recirculated by means of a pump through a first tube coupled in fluid communication with the pool and the pump, the system comprising in combination:

(a) a float chamber having an interior adapted to be coupled in fluid communication with the first tube;

(b) a float disposed in the float chamber, carrying a magnetic element;

(c) a magnetic switch responsive to the level of the magnetic element located in fixed position outside of the float chamber at a level corresponding to the desired water level, the magnetic switch assuming a first state if the pool water level is at least equal to the desired water level and assuming a second state if the pool water level is lower than the desired water level;

(d) a valve adapted to be connected between a pressurized water source and a pre-existing tube coupled in fluid communication with the pool; and (e) a circuit coupled to the valve and the magnetic switch so as to (1) close the valve when the pump is operating to prevent pressure of water being pumped through the first tube from influencing the level at which water is maintained in the pool, and (2) open the valve when the pump is not running and the magnetic switch is in the second state, wherein the float chamber is adapted to be disposed in the ground in which the pool is formed and is located beyond the extent of pool decking adjoining the pool.

13. A method for automatically maintaining a desired water level in a swimming pool in which the water is recirculated by means of a pump through a first tube coupled in fluid communication with the pool and the pump, the method comprising the steps of:

(a) fluid coupling water in the pool to a float chamber which is located outside of the pool by means of the first tube when the pump is off to produce in the float chamber a water level identical to the water level in the pool;

(b) moving a float disposed in the float chamber to indicate the level of water in the pool;

(c) communicating information representing the level of the float to a sensor responsive to the level of the float and located outside of the float chamber at a level corresponding to the desired water level so that the sensor assumes a first state if the pool water level is at least equal to the desired water level and assumes a second state if the pool water level is lower than the desired water level; and (d) opening a valve connected between a pressurized water source and a pre-existing tube coupled in fluid communication with the pool only when the pump is turned off and the sensor is in the second state, the valve otherwise being closed.

14. The method of claim 13 including accomplishing the communicating of step (c) by magnetic coupling between the float and the sensor, the sensor being a magnetic coupling sensor.

15. The method of claim 13 including interrupting the communicating of step (c) in response to lowering of the float. due to suction of water out of the float chamber into the suction tube when the pump is on.

16. A method for automatically maintaining a desired water level in a swimming pool in which the water is recirculated by means of a pump through a first tube coupled in fluid communication with the pool and the pump, the method comprising the steps of:

(a) fluid coupling water in the pool to a float chamber which is located outside of the pool by means of the first tube when the pump is off to produce in the float chamber a water level identical to the water level in the pool;

(b) moving a float disposed in the float chamber to indicate the level of water in the pool;

(c) communicating information representing the level of the float to a sensor responsive to the level of the float and located outside of the float chamber at a level corresponding to the desired water level so that the sensor assumes a first state if the pool water level is at least equal to the desired water level and assumes a second state if the pool water level is lower than the desired water level;

(d) opening a valve connected between a pressurized water source and a pre-existing tube coupled in fluid communication with the pool only when the pump is turned off and the sensor is in the second state, the valve otherwise being closed; and (e) controlling the pump by a timing device that energizes a primary winding of a transformer only when the pump is turned off, the transformer having a secondary winding coupled to the valve.

17. A method for automatically maintaining a desired water level in a swimming pool in which the water is recirculated by means of a pump through a first tube coupled in fluid communication with the pool and the pump, the method comprising the steps of:

(a) fluid coupling water in the pool to a float chamber which is located outside of the pool by means of the first tube when the pump is off to produce in the float chamber a water level identical to the water level in the pool;

(b) moving a float disposed in the float chamber to indicate the level of water in the pool;

(c) communicating information representing the level of the float to a sensor responsive to the level of the float and located outside of the float chamber at a level corresponding to the desired water level so that the sensor assumes a first state if the pool water level is at least equal to the desired water level and assumes a second state if the pool water level is lower than the desired water level;

(d) opening a valve connected between a pressurized water source and a pre-existing tube coupled in fluid communication with the pool only when the pump is turned off and the sensor is in the second state, the valve otherwise being closed; and (e) preventing further overfilling of the pool if it is already overfilled, by limiting upward movement of the float by a stop element, the stop element being positioned so as to cause the magnetic coupling to remain strong enough to maintain the sensor in the first state.

18. A system for automatically maintaining a desired water level in a body of water in which the water is recirculated by a pump through a water recirculation piping circuit, the system comprising in combination:

(a) a float chamber located outside of the body of water having an interior adapted to be coupled in fluid communication with the water recirculation piping circuit;

(b) a float disposed in the float chamber;

(c) a sensor responsive to the level of the float located in fixed position relative to the float chamber at a level corresponding to the desired water level, the sensor assuming a first state if the water level of the body of water is at least equal to the desired water level and assuming a second state if the water level of the body of water is lower than the desired water level;

(d) a valve adapted to be connected between a pressurized water source and the water circulation piping circuit; and (e) a circuit coupled to the valve and the sensor to (1) close the valve when the pump is operating to prevent pressure of water being pumped through the water recirculation piping circuit from influencing the level at which water is maintained, and (2) open the valve when the pump is not running and the sensor switch is in the second state.

* * * * *